US007001290B2

(12) United States Patent
Mower et al.

(10) Patent No.: US 7,001,290 B2
(45) Date of Patent: Feb. 21, 2006

(54) BLOW MOLDED BASKETBALL BACKBOARD FRAME

(75) Inventors: Barry D. Mower, Layton, UT (US); Robert Astle, Farmington, UT (US); Carl R. Stanford, Clinton, UT (US); Stephen F. Nye, Syracuse, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 10/352,940

(22) Filed: Jan. 29, 2003

(65) Prior Publication Data

US 2003/0158005 A1 Aug. 21, 2003

Related U.S. Application Data

(60) Provisional application No. 60/357,404, filed on Feb. 15, 2002.

(51) Int. Cl.
*A63B 63/08* (2006.01)

(52) U.S. Cl. ..... 473/481; D21/701

(58) Field of Classification Search ..... 473/476, 473/472, 479, 484, 485, 486, 488, FOR 10, 473/415, 433, 447, 448, 481; D21/302, 305, D21/314, 355, 698, 699, 701–704, 781
See application file for complete search history.

(56) References Cited

U.S. PATENT DOCUMENTS 4,478,415 A 10/1984 Shaffer et al.
5,082,261 A * 1/1992 Pelfrey ..... 473/483
5,507,484 A 4/1996 van Nimwegen et al.
D402,338 S 12/1998 Davis
5,902,198 A 5/1999 Martin et al.
6,004,231 A * 12/1999 Schickert et al. ..... 473/481
6,007,437 A 12/1999 Schickert et al.
D438,920 S * 3/2001 Matteucci et al. ..... D21/701
6,367,948 B1 * 4/2002 Branson ..... 362/234
6,468,373 B1 * 10/2002 Grinwald et al. ..... 156/82

OTHER PUBLICATIONS

WebPage, Backboard Ad,www.dickssportinggoods.com/product/index.jsp, Download Date Aug. 27, 2004, 2 pages.*
Communication Pursuant to Article 96(2), European Patent Application No. 03250923.4, issued Dec. 3, 2003, 5 pages.
Communication Pursuant to Article 96(2), European Patent Application No. 03 250 923.4, issued May 11, 2004, 2 pages.

* cited by examiner

*Primary Examiner*—Gregory Vidovich
*Assistant Examiner*—M. Chambers
(74) *Attorney, Agent, or Firm*—Workman Nydegger

(57) ABSTRACT

A basketball goal system having a lightweight blow molded support frame and a transparent acrylic backboard is disclosed. The support frame includes an outer periphery and a support structure that is disposed within the outer periphery. The support structure divides the frame into two or more sections and at least a portion of the two or more sections are preferably covered by the acrylic backboard. Advantageously, the support structure and frame can create a lightweight basketball backboard with consistent rebounding characteristics.

49 Claims, 13 Drawing Sheets

BLOW MOLDED BASKETBALL BACKBOARD FRAME

CROSS-REFERENCE TO RELATED APPLICATIONS

This application claims priority to and the benefit of U.S. Provisional Patent Application Ser. No. 60/357,404, entitled Blow Molded Basketball Backboard Frame, which was filed on Feb. 15, 2002, and is hereby incorporated by reference in its entirety.

BACKGROUND OF THE INVENTION

1. Field of the Invention

The present invention generally relates to basketball backboards and, in particular, to a basketball backboard frame that is constructed from blow-molded plastic.

2. Description of Related Art

As the game of basketball continues to increase in popularity, a large number of people have purchased basketball systems for use at their homes. Such basketball systems typically include a support pole, which is held in a fixed position while playing the game of basketball, and goal assembly that is attached to the upper portion of the support pole. The goal assembly, which is suspended a given distance above a playing surface, includes a basketball backboard and goal or hoop.

Conventional basketball systems designed for use at home often include basketball backboards with a metal frame that is constructed from a number of individual sections that are joined together. The metal frame is typically attached to the support pole by a support structure that includes two or more elongated arms. The backboard, which often includes a rebound member or basketball backboard panel, is generally attached to the metal support frame by one or more screws or bolts. The assembly of the metal frame, however, often requires a significant amount of time and labor. In addition, because the metal frame is relatively heavy, a strong and sturdy support pole and connecting arms are required to support the basketball backboard and frame above the playing surface.

Basketball backboards for use with home basketball systems have previously been constructed from solid materials such as wood. Disadvantageously, wooden basketball backboards deteriorate over time, especially when used in outdoor environments because the backboards are constantly exposed to harsh weather environments such as rain and snow. Basketball backboards for home basketball systems have also been constructed from injection molded plastic. Injection molded plastic backboards, however, are relatively flexible and that causes poor rebounding characteristics. That is, when the basketball strikes the injection molded backboard, the backboard will flex and the basketball will not bounce off of the backboard in a consistent manner. In order to overcome this problem, injection molded plastic backboards typically include strengthening ribs and other complex structures in an attempt to make the backboards more rigid. These strengthening ribs and other structures, however, increase the weight and cost of the backboard. Additionally, known basketball backboards may be constructed using a structural foam material with an internal cellular structure and a hard external shell. This type of backboard requires a multiple step manufacturing process, which increases the time and cost to manufacture the backboard.

One feature of home basketball systems that is becoming more popular is the use of transparent or clear backboards, so that the backboards resemble those used in professional and collegiate games. In particular, most professional leagues and major colleges use tempered glass backboards to allow spectators to view the game through the backboard. Tempered glass backboards are generally three-eighths (3/8) to one-half (1/2) of an inch thick, and the tempered glass is very heavy. Thus, a large support frame and pole are required to support the glass backboard above the playing surface.

In order to create a look similar to the tempered glass backboards used in professional and college games, transparent or clear backboards are now being used in connection with home basketball systems. For example, conventional home basketball systems may use a welded steel frame with a clear, planar acrylic panel attached to the front surface of the frame. Disadvantageously, the outer edges of the acrylic panel are often exposed and not supported by the metal frame. This allows the edges of the acrylic panel to be broken or damaged when struck by a basketball or other object. The broken or damaged acrylic panels are generally very difficult and expensive for the consumer to fix or replace.

Conventional basketball backboards constructed from acrylic panels may also be attached to the frame by double-sided adhesive tape. The double-sided adhesive tape must securely bond the backboard to the frame. The double-sided tape must also allow impact energy from the basketball striking the backboard to be transferred to the frame, and the tape must have sufficient flexibility to dissipate the impact energy from the backboard to the frame. If the attachment of the basketball backboard to the frame is too rigid, then the backboard can fracture. On the other hand, if the attachment of the basketball backboard to the frame is too loose, then backboard may dislodge or separate from the frame and it may fall to the playing surface. This often damages the backboard and it creates a safety hazard for persons playing basketball.

The process for attaching acrylic basketball backboards to the frame with double-sided adhesive tape is relatively time consuming and labor intensive. In particular, in order to attach the backboard to the frame, the frame and acrylic backboard must first be cleaned and/or prepared to receive the double-sided tape. The tape must also be cut or formed into the proper size and then the backing on one side of the tape is removed. The tape is then attached to the frame and the backing on the other side of the tape is removed. The acrylic panel is then attached to the frame, and the panel and frame must be firmly pressed together to ensure complete adhesion and attachment of the panel and frame. The panel and frame must then be carefully checked to ensure the tape is securely attached the panel to the frame.

It is known to use double-sided adhesive tape with a foam center to attach the backboard to the frame. One suitable type of double-sided adhesive tape, known as "VHB" tape, is commercially available from the Minnesota Mining and Manufacturing Co. (3M) of Saint Paul, Minn. and the Norton Company of Worchester, Mass.

It is also known to use an injection molded plastic frame to support a transparent acrylic backboard. The injection molded plastic frame includes separately molded front and rear sections that are connected to form the frame. In particular, the front and rear sections of the frame may include alignment features that allow the sections to be attached in the desired manner and a slot or opening Is disposed between the front and rear sections. A substantially planar rebound member constructed from molded plastic is inserted into the slot to form the basketball backboard. The injection molded frame typically requires structural foam or fiberglass-reinforced plastic to provide the required strength to support the rebounding member and provide the proper rebound performance.

Disadvantageously, the two-piece, injection molded plastic frame is relatively heavy and it requires a significant amount of labor to attach the front and rear sections of the frame and insert the rebound member into the slot between the sections. Significantly, this type of basketball backboard generally does not have a flat front surface. In particular, because the rebound member is located between the front and rear sections, the outer portion of the frame is not aligned with the front face of the rebound member. Thus, the backboard has an uneven front surface and when a basketball strikes the uneven surfaces, the basketball will not have a true bounce and unexpected results may occur.

BRIEF SUMMARY OF THE INVENTION

A need therefore exists for a basketball backboard frame that eliminates the above-described disadvantages and problems.

One aspect of the basketball backboard frame is it is desirably constructed from blow-molded plastic and it includes a generally hollow interior portion. Significantly, the lightweight basketball backboard frame can be easily transported, which decreases shipping costs. The lightweight basketball backboard frame can also be easily moved and stored. Additionally, the lightweight basketball backboard frame allows a basketball goal system to be easily constructed and assembled. Further, because the basketball backboard frame is lightweight, it does not require a large support structure to support the backboard above the playing surface.

Another aspect of the basketball frame is one or more depressions, "tack-offs" or "kiss-offs," may be formed in the frame. The depressions, which extend from one surface towards another surface, are desirably sized and configured to increase the strength and/or rigidity of the frame. Preferably, the depressions extend from one surface and contact or engage an opposing surface, but the depressions do not have to contact or engage the opposing surface. The depressions are desirably formed in the back or rear surface of the basketball backboard frame so that the depressions are generally not visible while playing the game of basketball. The depressions, however, may also be formed in the front surface or other surfaces of the basketball backboard frame. If the depressions are formed in the front surface of the frame, these depressions may be covered in whole or in part by the backboard or rebound member. In addition, one or more depressions may be formed in the rear surface of the frame and one or more depressions may be formed in the front surface of the frame, and these opposing depressions may be generally aligned. At least a portion of these opposing depressions preferably contact or engage each other, but the opposing depressions do not touch or engage. Finally, a portion of the basketball backboard frame may include one or more depressions on one surface and one or more depressions in an opposing surface.

Advantageously, the blow-molded plastic basketball backboard frame is relatively strong because it preferably includes two or more opposing walls or surfaces that are separated by a given distance. The opposing walls help create a high-strength, rigid basketball backboard frame. Because the interior portion of the frame between the opposing walls is generally hollow, that creates a lightweight backboard frame. Significantly, the strong and sturdy basketball backboard frame can withstand repeated impacts with a basketball or other similar objects. Further, the strong and rigid frame securely supports the backboard, which allows a basketball system with good rebounding characteristics to be constructed.

Significantly, the basketball backboard frame can be quickly and easily constructed because it is preferably constructed using a blow-molded plastic process. Advantageously, the blow-molding process allows the double walls and any suitable number of depressions to be quickly and easily formed. As discussed above, the double walls and depressions allow a strong and sturdy frame to be constructed. These and other features also allow the basketball backboard frame to be constructed with relatively thin plastic walls and that reduces the amount of materials used to construct the frame. This saves manufacturing costs and reduces the amount of resources required to construct the frame. The thin plastic walls also allow the frame to be cooled more quickly during the manufacturing process, and that saves time and further decreases costs.

Yet another aspect of the basketball backboard frame is it can be constructed in any desired configuration, shape, size and design depending, for example, upon the intended use and/or configuration of the backboard. Significantly, if the basketball backboard frame is constructed from blow-molded plastic, it can easily be formed into any desired size, configuration, and color. Further, basketball backboard frames constructed from blow-molded plastic are durable, weather resistant and generally temperature insensitive. The blow-molded plastic basketball backboard frames, in contrast to conventional metal frames, do not corrode, rust or otherwise deteriorate over time.

Another aspect of the basketball backboard frame is it preferably includes an outer periphery or exterior. This outer periphery, for example, may have a generally rectangular configuration with generally parallel disposed upper and lower surfaces. The outer periphery of the frame, however, may also be curved, fan-shaped or have other desired shapes and configurations. The outer periphery desirably encloses a generally open center portion. This generally open center portion further decreases the weight of the frame.

Still another aspect of the basketball backboard frame is a generally H-shaped support structure may be disposed within the outer periphery of the frame. The H-shaped support structure preferably divides the frame into four distinctive areas with a right side portion, left side portion, upper center portion and lower center portion. Advantageously, the H-shaped support structure allows the basketball backboard or rebound member to be securely supported.

A further aspect is a basketball backboard frame with a generally Y-shaped support structure disposed within the outer periphery of the frame. The Y-shaped support structure preferably divides the frame into three distinctive areas with a right side portion, left side portion and a center portion. The Y-shaped support structure also allows the basketball backboard or rebound member to be securely supported.

Another aspect of the basketball backboard frame is a generally X-shaped support structure may be disposed within the outer periphery of the frame. The X-shaped support structure preferably divides the frame into at least three distinctive areas with a right side portion, left side portion, and a center portion. The X-shaped support structure can also divide the frame into four or more distinctive areas with a right side portion, left side potion, upper center portion and lower center portion. Advantageously, the X-shaped support structure also allows the basketball backboard or rebound member to be securely supported.

Yet another aspect of the basketball backboard frame is a double I-shaped support structure may be disposed within the outer periphery of the frame. The double I-shaped support structure consists of two generally vertical members which preferably divide the frame into three distinctive areas with a right side portion, left side portion, and a center portion. In a preferred embodiment of the I-shaped support structure, the right, left and center areas are of equal area. Advantageously, the double I-shaped support structure also allows the basketball backboard or rebound member to be securely supported.

Another aspect of the basketball backboard frame is an adhesive is preferably used to bond the backboard to the frame. The backboard is preferably a generally flat, planar structure that is constructed from acrylic. Advantageously, acrylic basketball backboards may be clear or generally transparent to allow light to be transmitted through the backboard. The backboard may also contain designs, graphics, or other printed material. The backboard is preferably attached to the frame by an elastomeric adhesive. More preferably, a silicon based adhesive is used to attach the backboard to the frame, but other types of adhesives may also be used. The backboard is preferably spaced from the frame by a bond gap, and the size of the bond gap may be controlled by bond gap spacers. The bond gap spacers may either be structural elements of the support frame or be a separate structure within the adhesive. Beads, for example, may be used as bond gap spacers.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further clarify the above and other aspects, advantages and features of the present invention. It will be appreciated that these drawings depict only preferred embodiments of the invention and are not intended to limits its scope. The invention will be described and explained with additional specificity and detail through the use of the accompanying drawings in which.

DETAILED DESCRIPTION OF THE PREFERRED EMBODIMENTS

The present invention is directed towards a basketball backboard frame. The principles of the present invention, however, are not limited to a basketball backboard frame. It will be understood that, in light of the present disclosure, the basketball backboard frame disclosed herein can be successfully used in connection with other types of basketball and sporting equipment.

Additionally, to assist in the description of the basketball backboard frame, words such as top, bottom, front, rear, right and left are used to describe the accompanying figures. It will be appreciated, however, that the present invention can be located in a variety of desired positions—including various angles, sideways and even upside down. A detailed description of the basketball backboard frame now follows.

Figure 1:
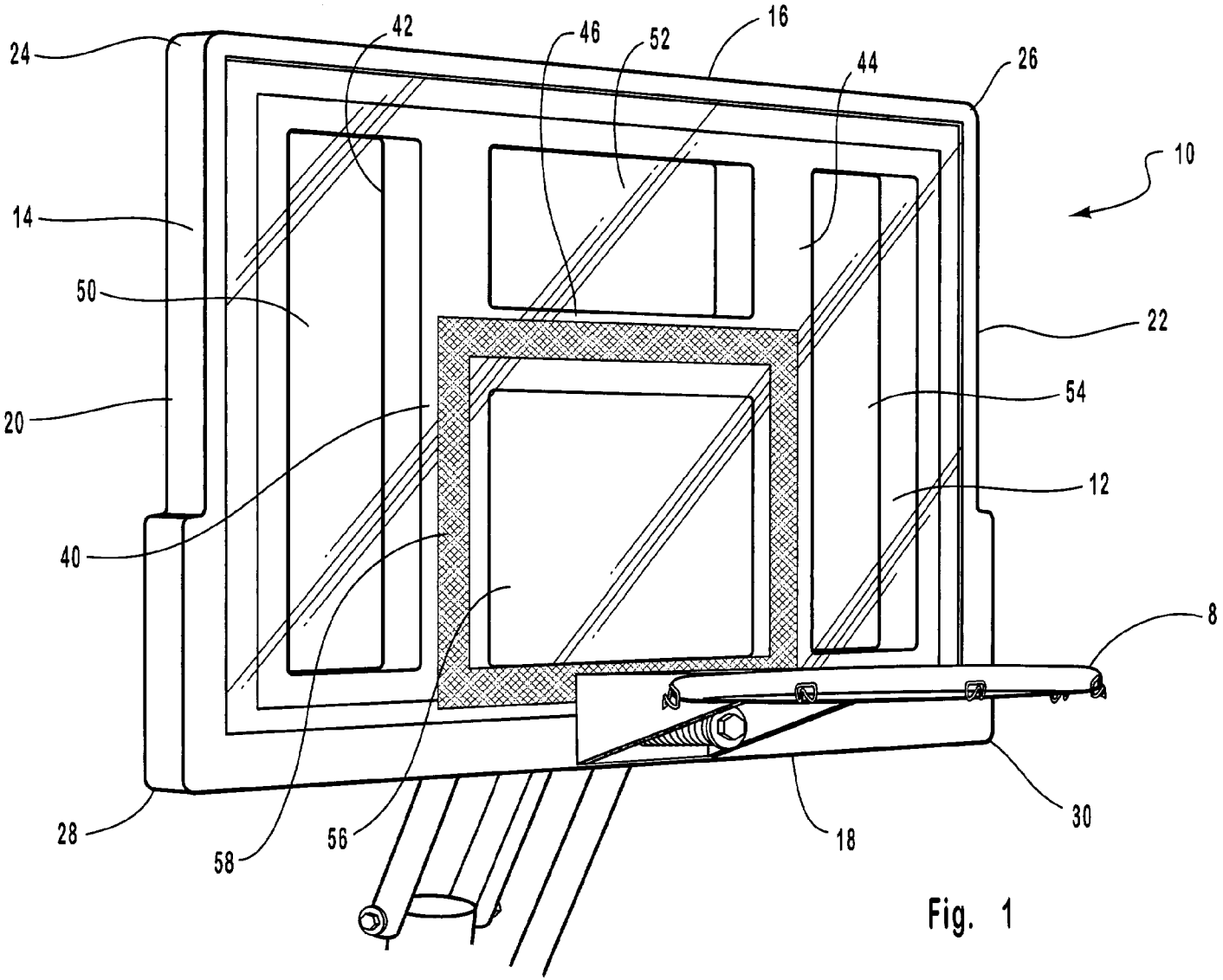
FIG. 1 is a perspective view of a basketball backboard frame in accordance with a preferred embodiment of the invention, illustrating a basketball backboard attached to the basketball backboard frame and a generally H-shaped support structure.

As seen in FIG. 1, a basketball goal system 10 includes a backboard 12 and a support frame 14. The backboard 12 has a generally smooth, planar outer surface so that a basketball bounces or rebounds off the backboard in a consistent manner. The backboard 12 is preferably constructed from plastic and, in particular, from an acrylic sheet that has sufficient thickness so that it will not break during an ordinary game of basketball. The backboard 12 is preferably constructed from an acrylic sheet because it is lightweight, easy to manufacture, and allows the basketball goal system 10 to be easily assembled. In addition, the backboard 12 is preferably constructed from acrylic or other suitable clear, transparent or generally translucent materials so that light can pass through the backboard. This creates a basketball goal system 10 that is similar in appearance and characteristics to those used in professional and major college games. One skilled in the art, however, will realize that the backboard 12 can be constructed from any suitable materials and the backboard can be constructed from opaque or other types of solid materials.

The basketball backboard support frame 14 is preferably constructed from a lightweight material, such as plastic. Desirably, the support frame 14 is constructed from blow-molded plastic to create a strong, lightweight and durable frame. In greater detail, the support frame 14 is preferably constructed using a blow-molded plastic process, and the frame includes two opposing walls or surfaces that are separated by a given distance in order to create a strong and sturdy structure. In addition, the interior portion of the blow-molded support frame 14 is preferably generally hollow. Advantageously, this creates a support frame 14 that is lightweight, strong and rigid, which allows the frame to withstand repeated impacts with a basketball or other similar objects.

The basketball backboard support frame 14 is preferably constructed from blow-molded plastic because it can easily be formed into any desired size and configuration. The basketball backboard support frame 14 is also desirably constructed from blow-molded plastic because it is durable, weather resistant and generally temperature insensitive. Advantageously, the basketball backboard support frame 14 constructed from blow-molded plastic generally does not corrode, rust or otherwise deteriorate over time.

The basketball backboard support frame 14 is preferably constructed from lightweight, blow-molded plastic because weight reduction of the basketball goal system 10 is highly desirable. For example, many home basketball systems are marketed directly to consumers in retail stores. Thus, the purchaser may be required to bring the basketball system to a register to be purchased, load the system in a vehicle, and assemble the system at home. If the basketball backboard 12 and support frame 14 are heavy, then the weight of the basketball goal system 10 and the overall weight of the entire basketball system is increased. If the basketball goal system 10 is heavy, that may also require a heavier and more complex support system which further increases the overall weight of the basketball system. A consumer may be reluctant to purchase and assemble a basketball system that is too heavy.

Advantageously, constructing the basketball backboard support frame 14 from lightweight, blow-molded plastic decreases shipping costs, whether shipping the system from the manufacturer to a retailer or consumer. In contrast, conventional basketball backboard frames that were constructed from pieces of metal that were welded together were heavy and the extra weight increased shipping costs. The blow-molded basketball frame 14, however, is lightweight and it allows for the overall weight of the basketball goal system 10 to be decreased. The lightweight backboard support frame 14 also simplifies the attachment of the basketball goal system 10 to the support pole or other support structure (not shown) because the lighter weight goal system is easier to manipulate and control during the assembly process. Advantageously, because the basketball backboard support frame 14 is lightweight, the pole and/or other support structure does not have to support a heavy basketball goal system 10. This allows the pole and/or other support structure to be constructed from lighter weight materials.

As known to those skilled in the art, the height of the basketball goal system 10 may be adjustable and a counterbalance or counterweight may be used to support the goal system at the desired height. Significantly, because the basketball backboard support frame 14 may be constructed from lightweight blow-molded plastic, a smaller counterbalance or counterweight may be used to support the basketball goal system 10. Additionally, as known to those skilled in the art, the counterbalance may consist of a spring or piston that may be attached to various portions of the basketball goal system 10. The lightweight support frame 14 allows a smaller spring or piston to be used. The smaller spring, counterbalance or counter weight may further decrease the overall weight of the basketball system.

The basketball backboard support frame 14 is preferably constructed from blow-molded plastic because it allows multiple features to be formed in the frame. For example, various support and mounting structures may be created in the frame 14 during the blow-molding process. In particular, one or more holes used to mount a basketball goal 8 to the support frame 14 may be created during the blow-molding process. Thus, a drilling step can be eliminated from the manufacturing process. This and other features formed during the blow-molding process can save time and manufacturing costs. In addition, the features are preferably integrally formed in the frame 14 and simultaneously created during the blow-molding process. Because these features may be simultaneously formed during the blow-molding process, this may save costs because the overall manufacturing cost of a product generally increases with each additional manufacturing step.

The basketball backboard support frame 14 is also preferably constructed as a unitary, one-piece structure. Advantageously, this further decreases manufacturing costs and time because one or more components do not have to be assembled or fastened together. In addition, the one-piece structure allows a strong and sturdy support frame 14 to be manufactured. It will be appreciated that the support frame 14, however, may be constructed by one or more components that are fastened together by any suitable means.

As shown in the accompanying figures, the basketball backboard support frame 14 preferably has a generally rectangular outer periphery or exterior. For example, as shown in FIGS. 1 to 6, the support frame 14 includes a top surface 16 that is generally parallel to a bottom surface 18, and a left side 20 that is generally parallel to a right side 22 of the frame. It will be appreciated, however, that the outer edges of the frame 14 do not have to be generally parallel and the frame does not require a generally rectangular configuration. For example, the outer edges of the frame 14 can be curved, rounded, arched, fan-shaped, or have any suitable design and configuration depending, for example, upon the intended use of the frame.

The frame 14 also includes an upper left corner 24, an upper right corner 26, a lower left corner 28 and a lower right corner 30. As shown in FIGS. 1 to 6, the corners 24, 26, 28 and 30 are generally formed at about a 90° angle and the corners have a relatively small curved outer portion. The corners 24, 26, 28 and 30 shown in FIGS. 7 and 8, however, include a larger curved outer portion. The corners 24, 26, 28 and 30 shown in FIG. 9, in contrast, have a different curved outer portion. Desirably, the upper corners 24, 26 and lower corners 28, 30 have a similar size and appearance, but it will be appreciated that the corners may have varied or different sizes and configurations. It will also be appreciated that the corners 24, 26, 28 and 30 may have any suitable size, radius of curvature and/or configuration depending, for example, upon the intended use of the frame 14. Of course, if the frame 14 has a curved, rounded, arched, fan-shaped or other similar configuration, then the frame may not include one or more corners 24, 26, 28 or 30.

Figure 7:
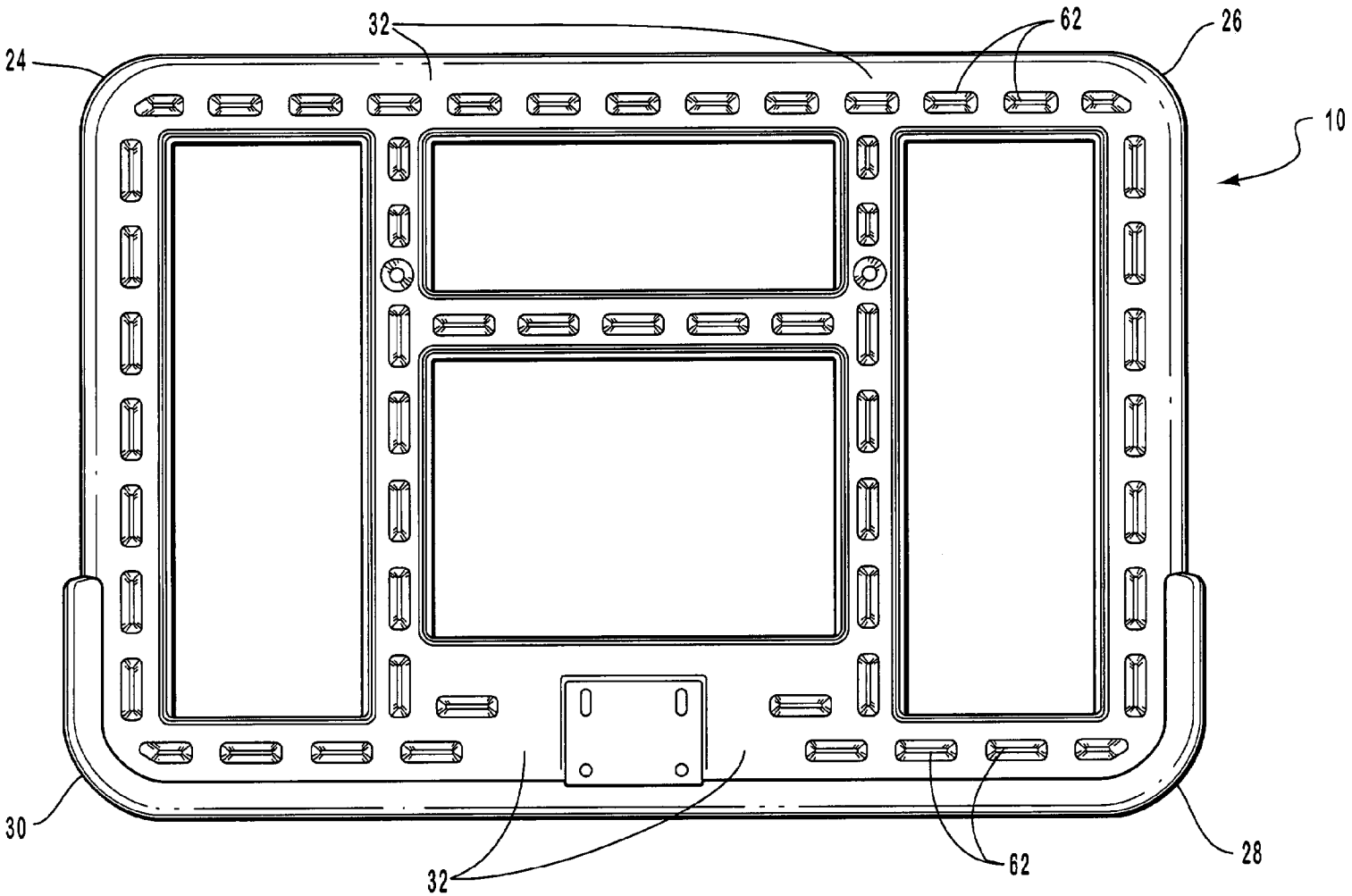
FIG. 7 is a front view of a basketball backboard frame in accordance with another preferred embodiment of the invention, illustrating a frame with a different exterior configuration.
Figure 8:
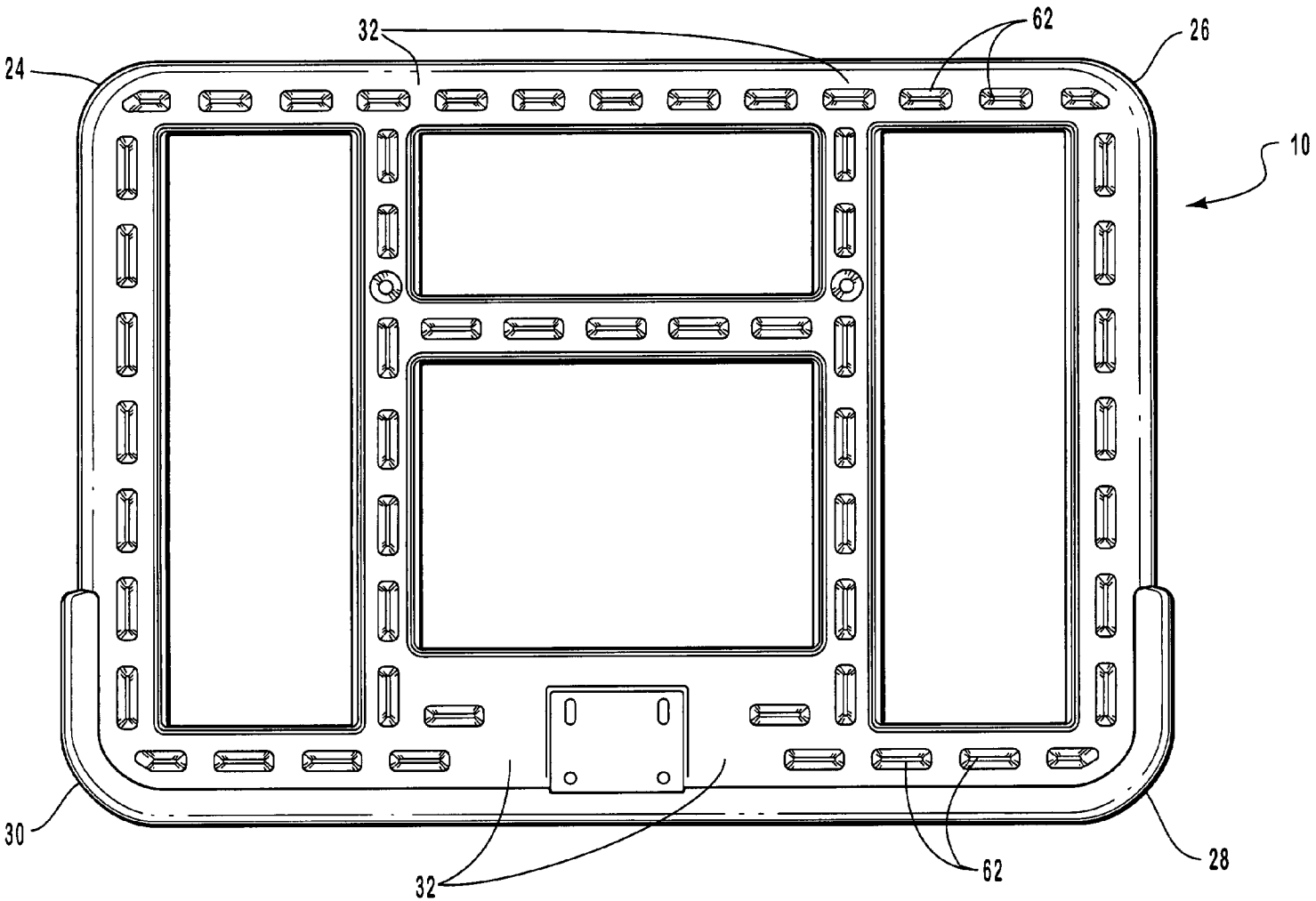
FIG. 8 is a front view of a basketball backboard frame in accordance with yet another preferred embodiment of the invention, illustrating a frame with a different exterior configuration.
Figure 9:
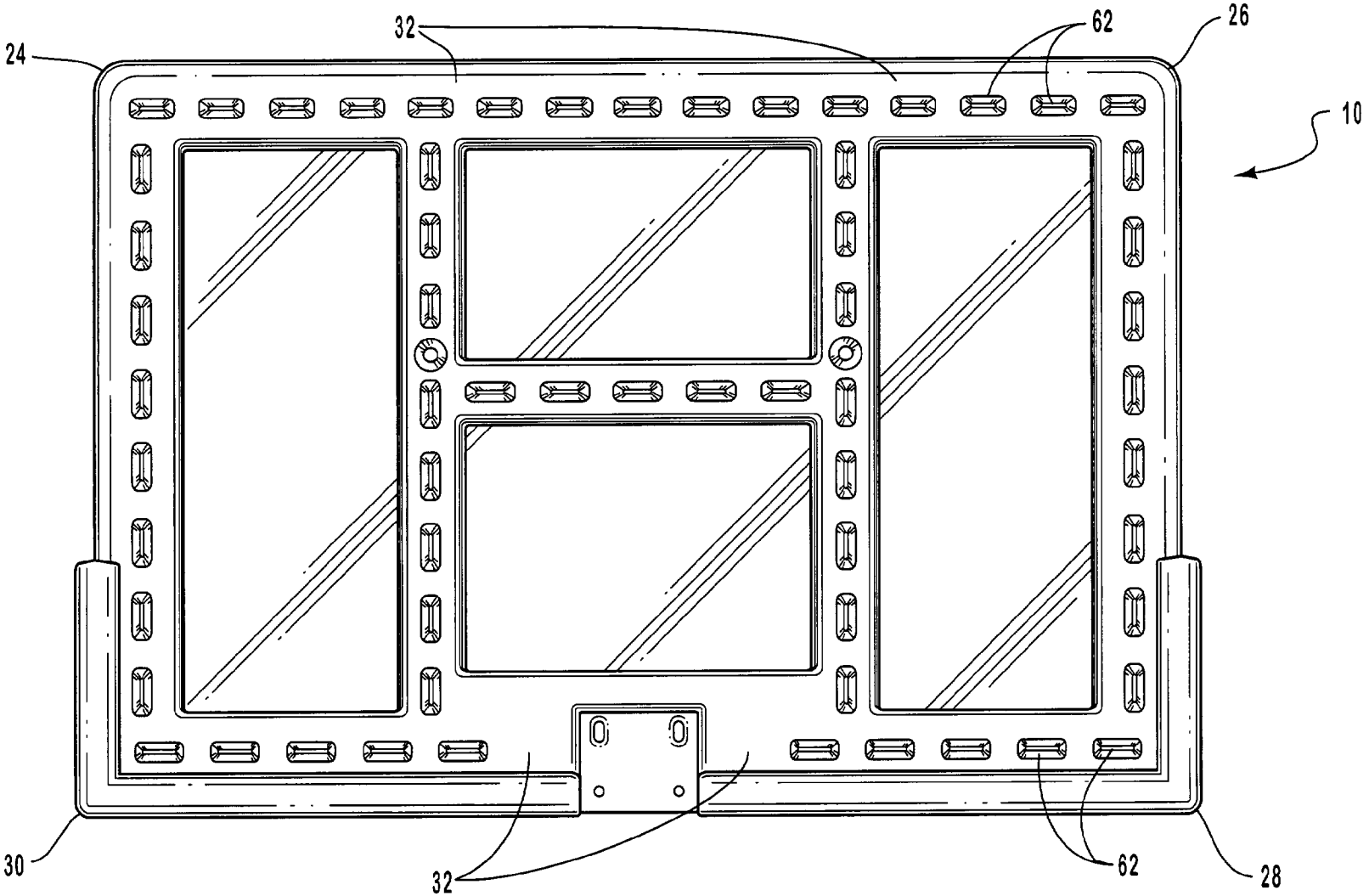
FIG. 9 is a front view of a basketball backboard frame in accordance with still another preferred embodiment of the invention.

As best seen in FIGS. 7–9, the basketball backboard support frame 14 preferably also includes one or more bonding surfaces 32 that are used when the backboard 12 is attached to the frame. The bonding surfaces 32 are located on the front face of the frame 14 and the bonding surfaces may cover all or a portion of the front face of the frame. The bonding surfaces 32 are preferably generally planar surfaces but the bonding surfaces may have any suitable configuration depending, for example, upon the size and configuration of the backboard 12. The bonding surfaces 32 are preferably formed during the blow molding process and these surfaces allow the backboard 12 to be securely attached to the support frame 14. As shown in the accompanying figures, the support frame 14 may include a gap, step or other alignment feature 34 to assist in aligning the backboard 12 relative to the frame. Desirably, the gap 34 has a thickness generally equivalent or the same as the thickness of the backboard 12. Thus, when the backboard 12 is attached to the frame 14, the front face of the frame and the backboard are aligned to create a generally planar surface. The backboard 12 desirably includes one or more bonding surfaces that are sized and configured to allow the backboard to be attached to the frame 14.

Figure 2:
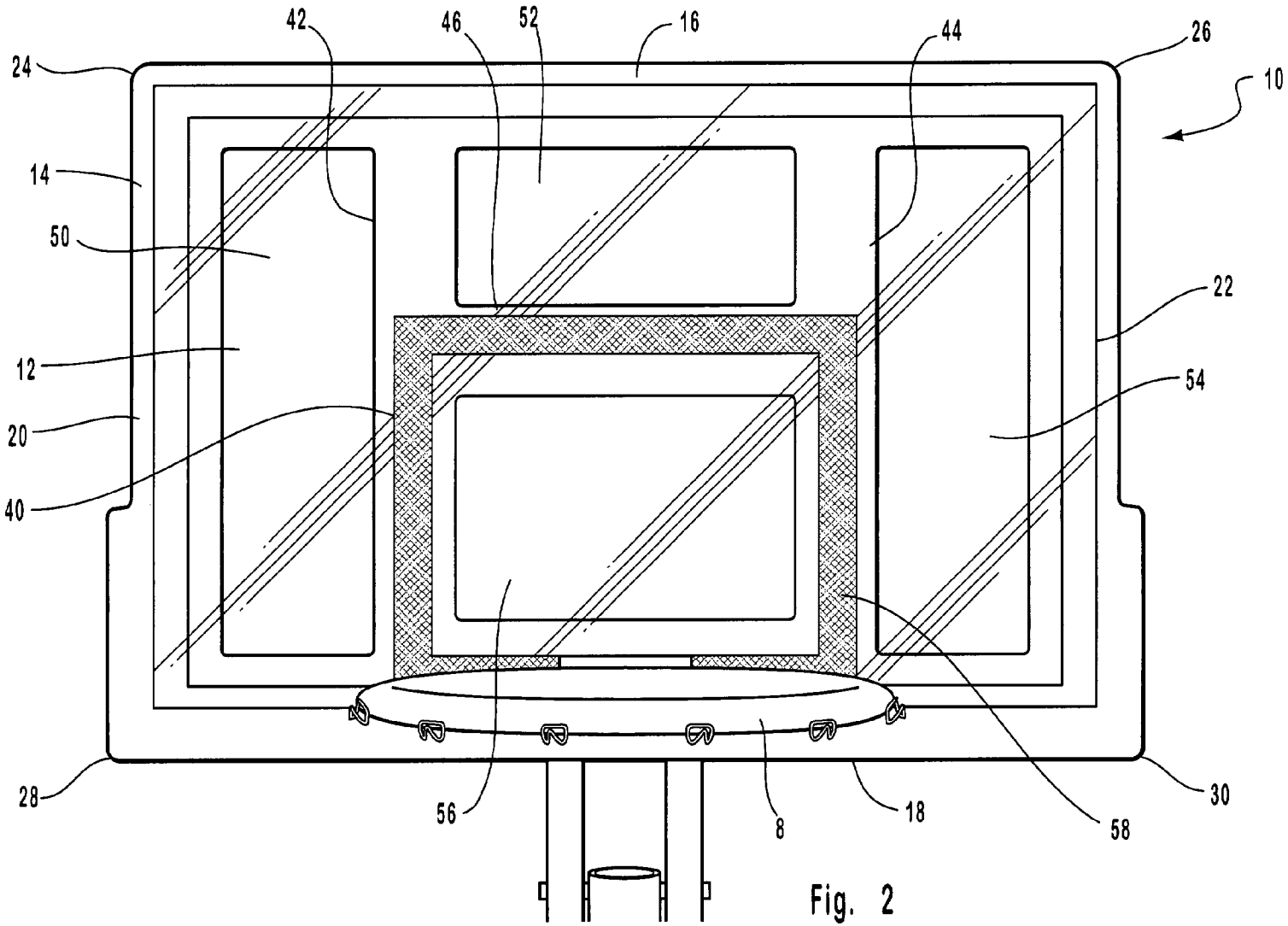
FIG. 2 is a front view of the basketball backboard frame and basketball backboard shown in FIG. 1.
Figure 3:
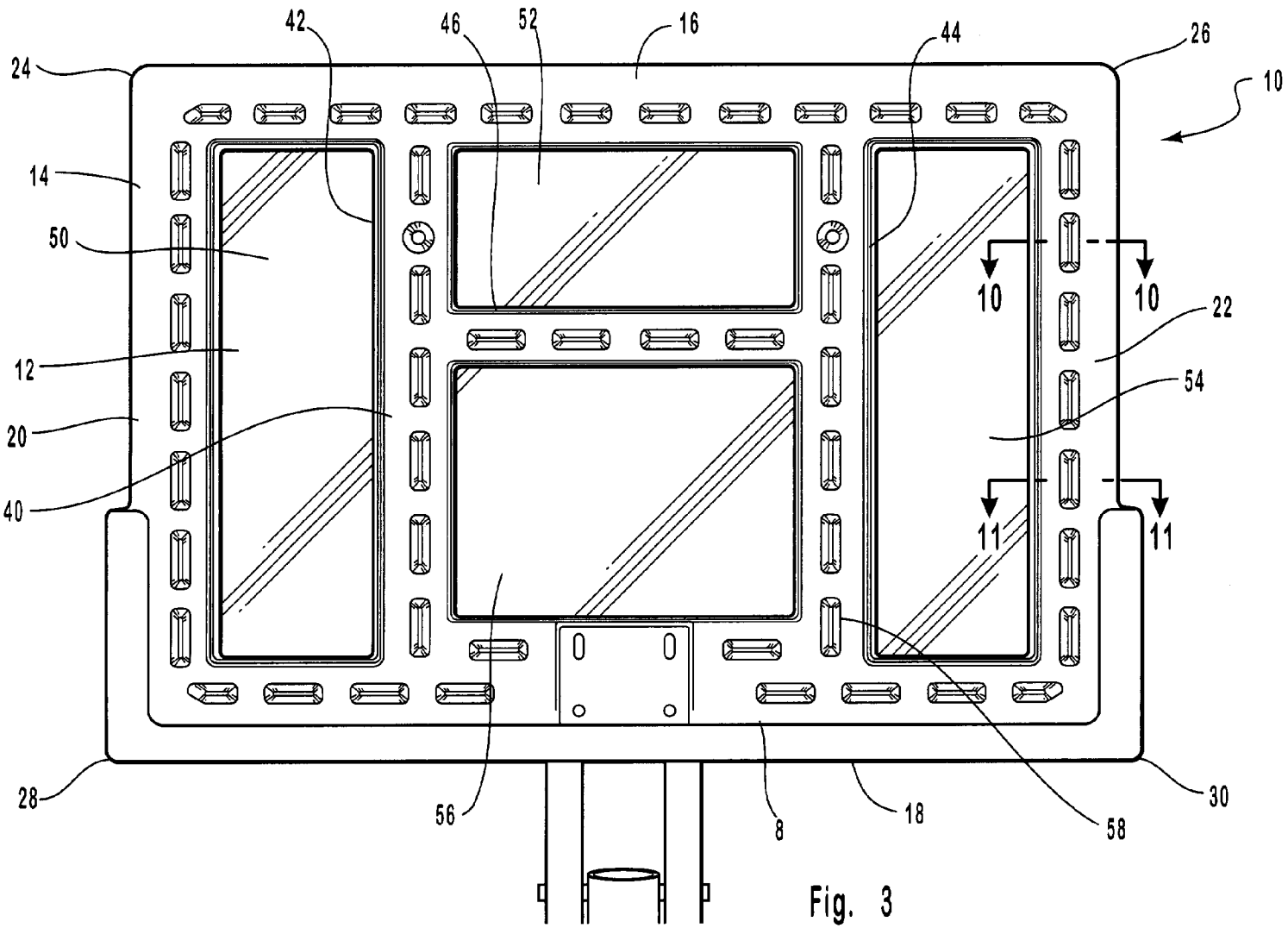
FIG. 3 is a rear view of the basketball backboard frame and basketball backboard shown in FIG. 1.

As shown in FIGS. 1–3, the basketball backboard frame 14 includes a generally "H"-shaped support structure 40 disposed between the outer edges or periphery of the frame. The generally "H"-shaped support structure 40 is preferably centrally disposed between the left side 20 and right side 22 of the frame 14, and the support structure 40 includes a first lateral support member 42, a second lateral support member 44 and a horizontal support member 46. One skilled in the art will recognize that the support structure 40 does not require a generally "H"-shaped configuration and the support structure can have any suitable size and configuration depending, for example, upon the intended use of the frame 14.

The "H"-shaped support structure 40 desirably divides the frame 14 into four distinctive openings or sections 50, 52, 54 and 56 disposed between the support structure and the periphery of the frame 14. Advantageously, the "H"-shaped support structure 40 and outer edges of the frame 14 securely support the backboard 12 such that a basketball rebounding from the backboard will deflect the backboard a minimal amount. This creates a backboard 12 with very good rebounding characteristics. Desirably, the rebounding characteristics of the basketball goal system 10 are generally similar to the rebounding characteristics of a one-piece, generally solid backboard. The large openings 50, 52, 54, and 56, however, allow a lightweight basketball goal system 10 to be created.

Figure 4:
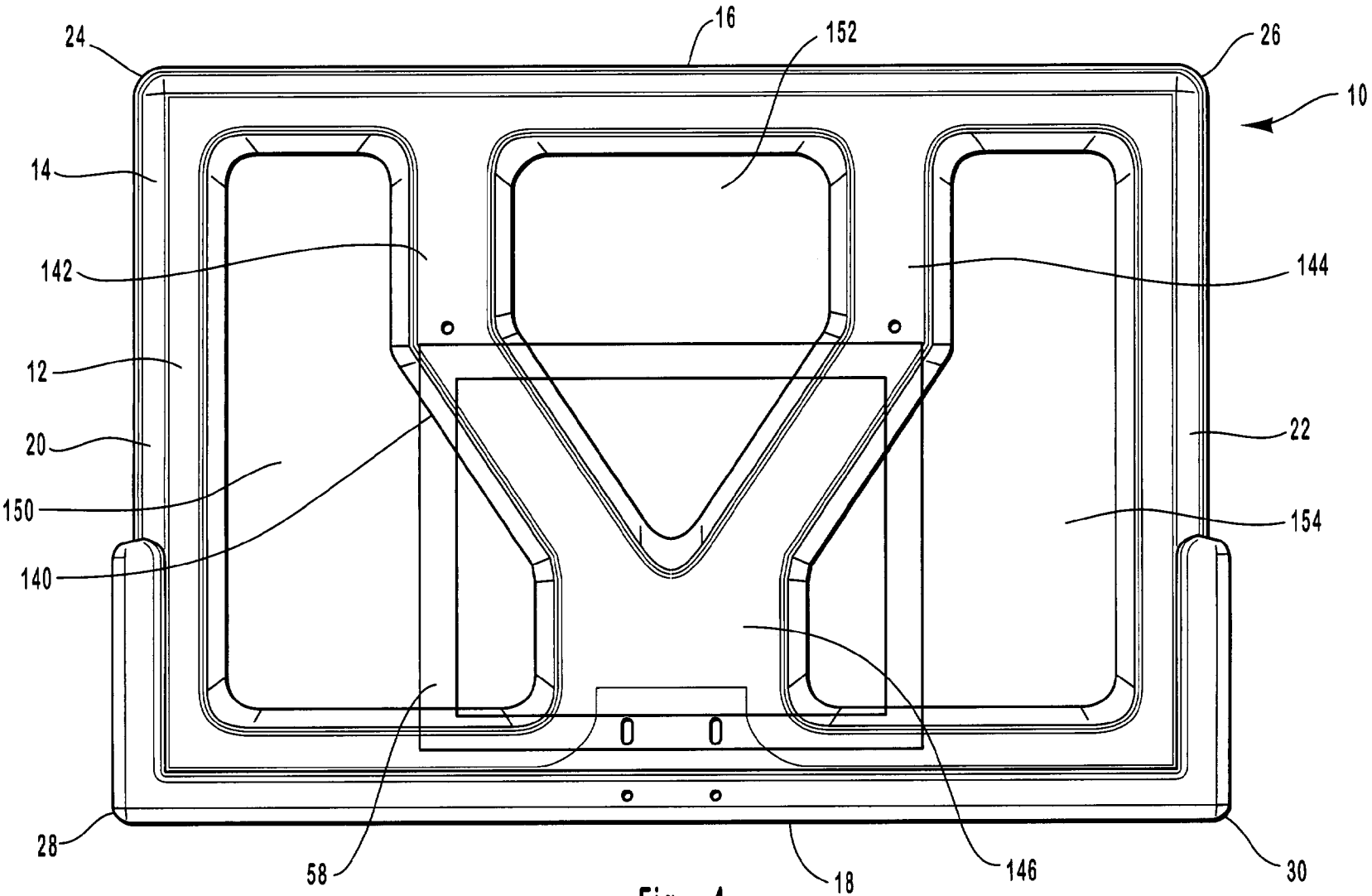
FIG. 4 is a front view of a basketball backboard frame in accordance with another preferred embodiment of the invention, illustrating a generally Y-shaped support structure.

As shown in FIG. 4, the basketball backboard frame 14 may also include a generally "Y"-shaped support structure 140 disposed between the outer edges or periphery of the frame. The generally "Y"-shaped support structure 140 is preferably centrally disposed between the left side 20 and right side 22 of the frame 14, and the support structure 140 includes a first lateral support member 142, a second support member 144, and a third support member 146.

The "Y"-shaped support structure 140 desirably divides the frame 14 into three distinctive openings or sections 150, 152, and 154 disposed between the support structure and the periphery of the frame 14. Advantageously, the "Y"-shaped support structure 140 and outer edges of the frame 14 securely support the backboard 12 such that a basketball rebounding from the backboard will deflect the backboard a minimal amount. This creates a backboard 12 with very good rebounding characteristics. Desirably, the rebounding characteristics of the basketball goal system 10 are generally similar to the rebounding characteristics of a one-piece, generally solid backboard. The large openings 150, 152, and 154, however, allow a lightweight basketball goal system 10 to be created.

Figure 5:
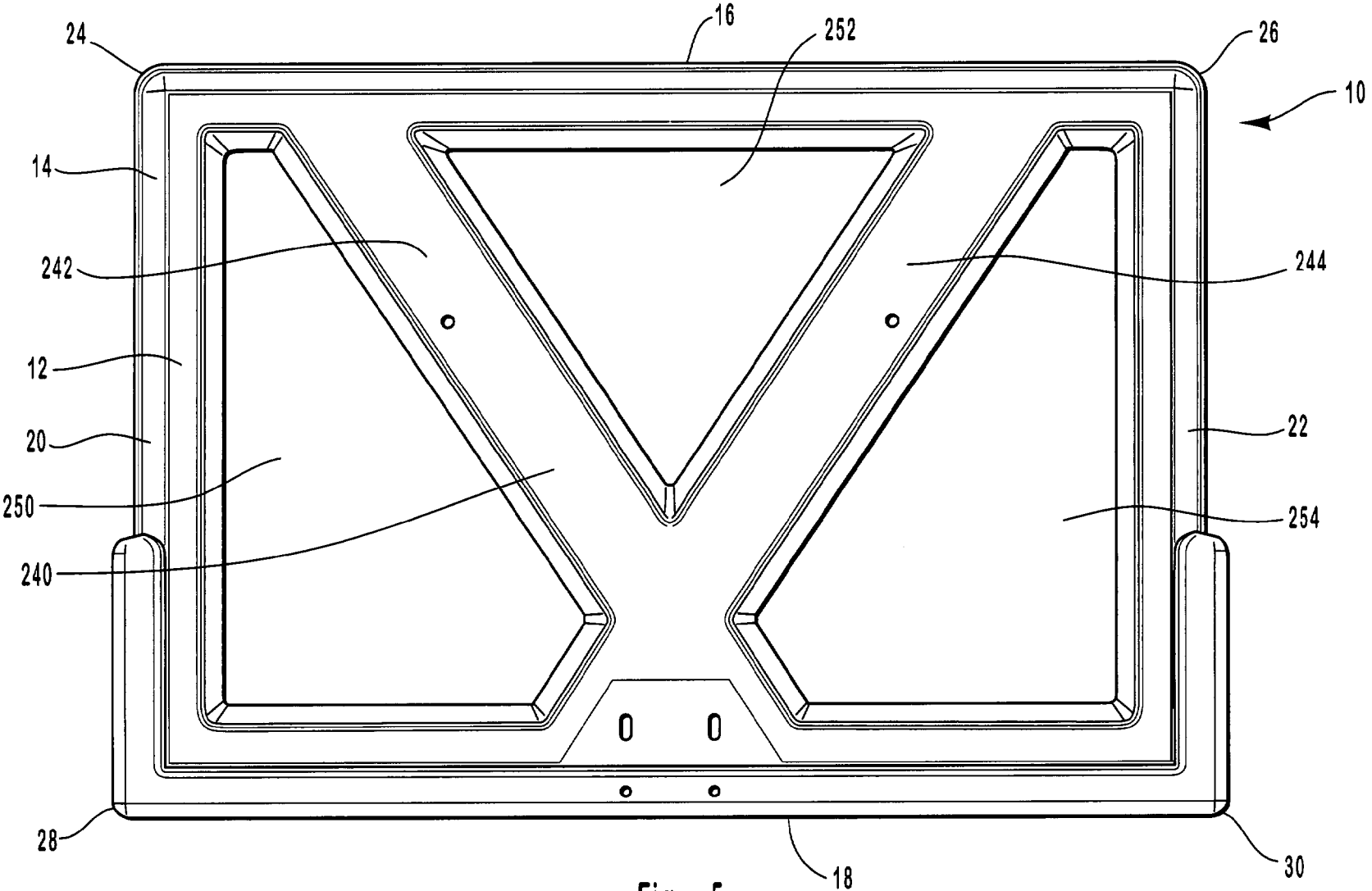
FIG. 5 is a front view of a basketball backboard frame in accordance with another preferred embodiment of the invention, illustrating a generally X-shaped support structure.

As shown in FIG. 5, the basketball backboard frame 14 may also include a generally "X"-shaped support structure 240 disposed between the outer edges or periphery of the frame. The generally "X"-shaped support structure 240 is preferably centrally disposed between the left side 20 and right side 22 of the frame 14, and the support structure 240 includes a first support member 242 and a second support member 244.

The "X"-shaped support structure 240 desirably divides the frame 14 into three distinctive openings or sections 250, 252, and 254 disposed between the support structure and the periphery of the frame 14. One skilled in the art will appreciate that the "X"-shaped support structure 240 may also divide the frame 14 into four or more distinctive openings or sections disposed between the support structure and the periphery of the frame 14. Advantageously, the "X"-shaped support structure 240 and outer edges of the frame 14 securely support the backboard 12 such that a basketball rebounding from the backboard will deflect the backboard a minimal amount. This creates a backboard 12 with very good rebounding characteristics. Desirably, the rebounding characteristics of the basketball goal system 10 are generally similar to the rebounding characteristics of a one-piece, generally solid backboard. The large openings 250, 252, and 254, however, allow a lightweight basketball goal system 10 to be created.

Figure 6:
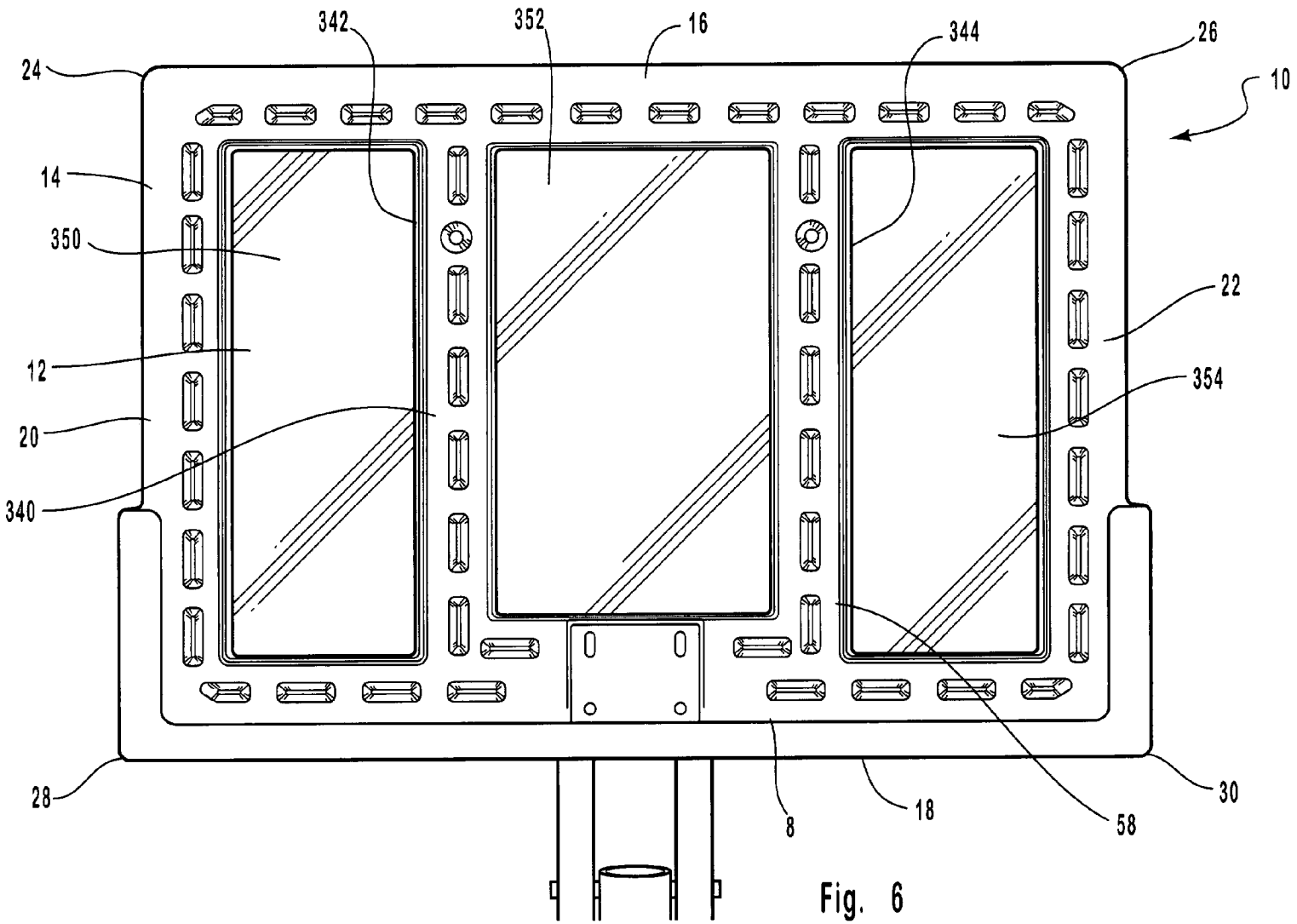
FIG. 6 is a front view of a basketball backboard frame in accordance with another preferred embodiment of the invention, illustrating a generally double I-shaped support structure.

As shown in FIG. 6, the basketball backboard frame 14 may also include a generally double "I"-shaped support structure 340 disposed between the outer edges or periphery of the frame. The generally double "I"-shaped support structure 340 is preferably centrally disposed between the left side 20 and right side 22 of the frame 14, and the support structure includes a first support member 342 and a second support member 344. The support members 342, 344 are preferably generally parallel aligned and perpendicular to the bottom surface 18 of the frame 14, but the support members can have any desirable configuration and/or alignment.

The double "I"-shaped support structure 340 desirably divides the frame 14 into three distinctive openings or sections 350, 352, and 354 disposed between the support structure and the periphery of the frame 14. These three openings may have generally the same size, or they may have different sizes, depending on the placement of the lateral support members 342, 344. Advantageously, the double "I"-shaped support structure 340 and outer edges of the frame 14 securely support the backboard 12 such that a basketball rebounding from the backboard will deflect the backboard a minimal amount. This creates a backboard 12 with very good rebounding characteristics. Desirably, the rebounding characteristics of the basketball goal system 10 are generally similar to the rebounding characteristics of a one-piece, generally solid backboard. The large openings 350, 352, and 354, however, allow a lightweight basketball goal system 10 to be created. Of course, one skilled in the art will appreciate that the support structure 340 could include only a single support member or more than two support members.

The "H", "Y", "X" and double "I"-shaped support structures 40, 140, 240, and 340, respectively, desirably create a high-quality, professional appearance for the basketball goal system 10. Basketball systems that are used in professional, major colleges and other such venues typically include backboards that are constructed from tempered glass. The tempered glass allows the game to be viewed through the backboard with minimal obstructions. The tempered glass, however, has a relatively large thickness to provide the strength required for the basketball system. These backboards are generally not practical for home or portable basketball systems because the tempered glass is very heavy, expensive, and can be easily scratched or otherwise damaged.

Advantageously, the support frame 14 and the variously shaped support structures provide a basketball goal system 10 that is similar to a professional backboard, and is lightweight and low cost. In particular, the support frame 14 and support structures 40, 140, 240, or 340 allow the backboard 12 to be constructed from a thin acrylic sheet. In addition, the variously shaped support structures 40, 140, 240, and 340 may be sized and configured such that a basketball target 58 covers or hides a portion of the support structure. For example, as seen in FIGS. 1 and 4, the basketball target 58 has a generally rectangular configuration and it is generally positioned above the basketball goal. As known to those skilled in the art, the basketball target 58 is used to provide a reference for shooting and rebounding a basketball from the backboard 12. Because the target 58 is present on most backboards 12, it can be used to hide portions of the support structures 40, 140, 240, or 340 from view. For example, the target 58 covers at least a portion of the first and second lateral support members 42, 44, and the horizontal support member 46 in the generally "H"-shaped support structure. This creates the appearance that the backboard 12 is only supported by the frame 12 and only the upper portions of the first and second lateral support members 42 and 44 are visible. Thus, the basketball goal system 10 has the appearance of a transparent professional backboard, however, the basketball goal system is substantially lighter than a professional system. It will be appreciated, however, that the support structures 40, 140, 240, 340, and the target 58 can have any suitable size and configuration depending upon the intended use of the basketball goal system 10. For example, upper portions of the support members 42, 44, 142, 144, 242, 244, 342, 344 can be curved, angled or have other desired shapes for aesthetic or functional purposes.

The frame 14 may also employ various other features such as the depressions 62 or "tack-offs" shown in FIGS. 3 and 6–9. The depressions 62, which extend from one surface towards the other surface, are desirably sized and configured to increase the strength and/or rigidity of the frame 14. Preferably, the depressions 62 extend from one surface and contact or engage an opposing surface, but the depressions do not have to contact or engage the opposing surface. The depressions 62 are desirably formed in the back or rear surface of the basketball backboard frame 14 so that the depressions are generally not visible while playing the game of basketball. The depressions 62, however, may also be formed in the front surface of the basketball backboard frame 14. These depressions 62 may be covered in whole or in part by the backboard 12 and/or target 58. In addition, one or more depressions 62 may be formed in the rear surface of the frame 14 and one or more depressions may be formed in the front surface of the frame, and these opposing depressions are preferably generally aligned. Desirably, at least a portion of these opposing depressions 62 contact or engage each other, but the opposing depressions do not have to touch or engage. One skilled in the art will appreciate that the number, size and location of the depressions 62 may depend upon factors such as the desired strength of the basketball goal system 10. Further, a portion of the basketball backboard frame 12 may include one or more depressions 62 on one surface and one or more depressions in an opposing surface. For example, the front surface of the frame 14 may include one or more depressions that are generally hidden by the target 58 and the rear surface of the frame 14 may also include one or more depressions 62 depending upon the desired characteristics of the basketball goal system 10.

Figure 10:
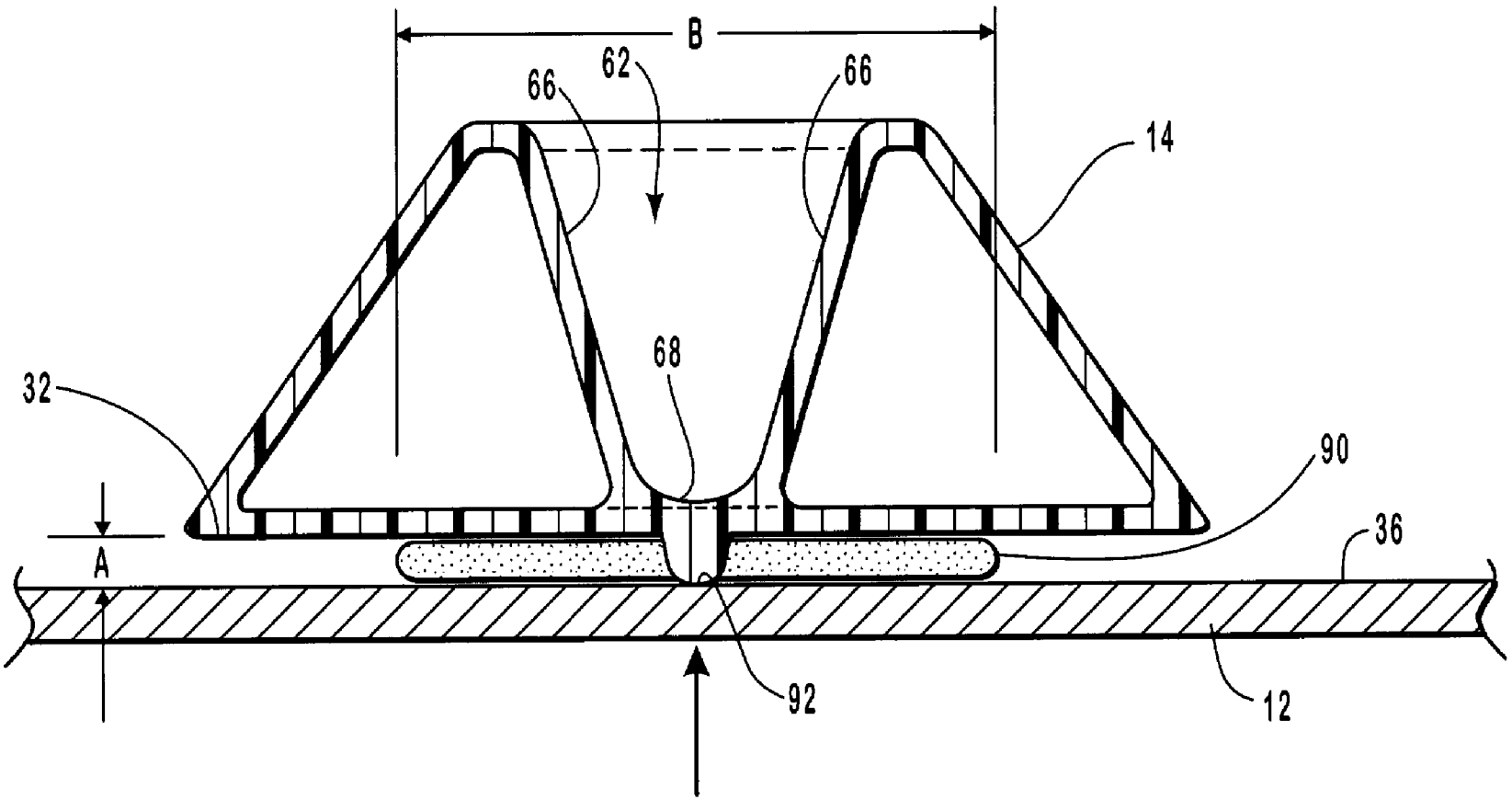
FIG. 10 is an enlarged cross-sectional side view of a portion of the basketball backboard frame and basketball backboard along lines 10—10 shown in FIG. 3, illustrating a depression with a distal end contacting an opposing surface.
Figure 11:
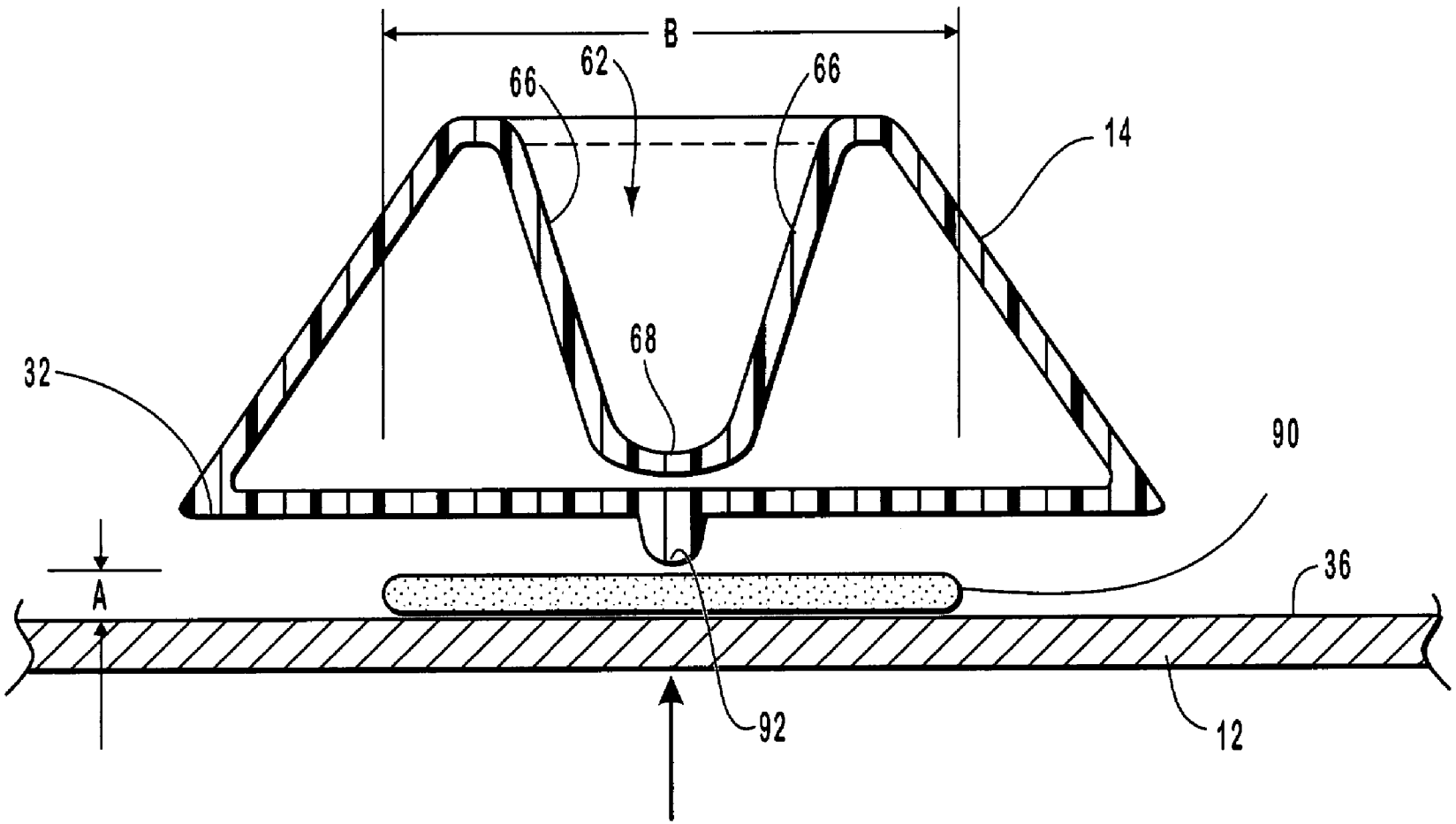
FIG. 11 is an enlarged cross-sectional side view of a portion of the basketball backboard frame and basketball backboard along lines 11—11 shown in FIG. 3, illustrating a depression with a distal end disposed proximate an opposing surface.

As seen in FIGS. 10 and 11, the depressions 62 preferably have generally tapered walls 66 and the end 68 of the depression may contact or engage the inner surface of the opposing wall. As discussed above, the end 68 of the depression 62 does not have to contact or engage the opposing surface as shown in FIG. 11. As shown in the accompanying figures, the depressions 62 preferably have a generally trapezoidal configuration. Advantageously, the trapezoidal configuration provides desirable bearing and torsional characteristics for the basketball goal system 10. For example, the trapezoidal shape appears to prevent the support frame 14 from bending or yielding when a basketball rebounds from the backboard 12. Thus, the basketball goal system 10 tends to have rebounding characteristics that are similar to larger and heavier backboards.

Figure 12:
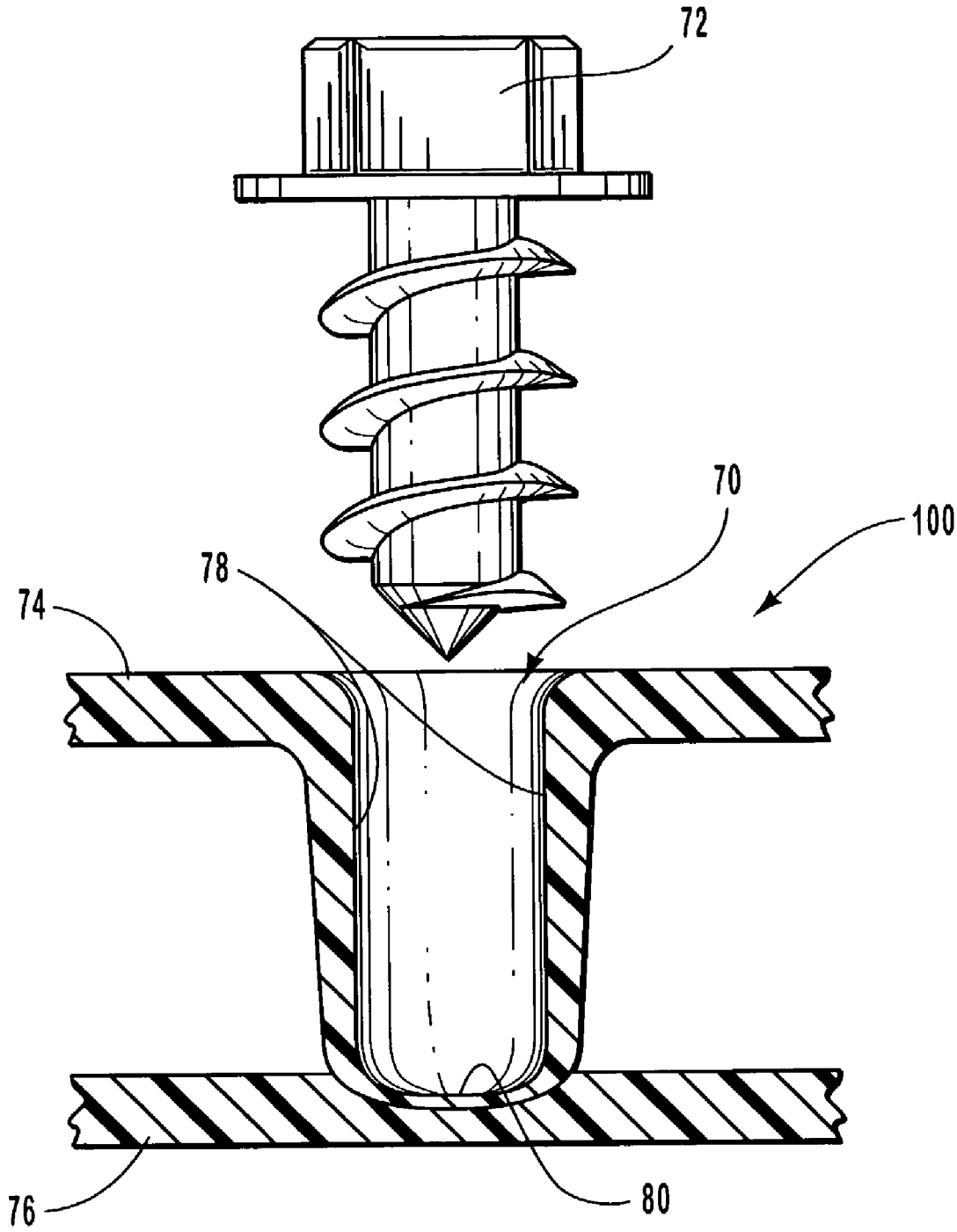
FIG. 12 is an enlarged cross-sectional side view of an exemplary portion of a basketball backboard frame, illustrating a screw boss and an exemplary fastener.
Figure 13:
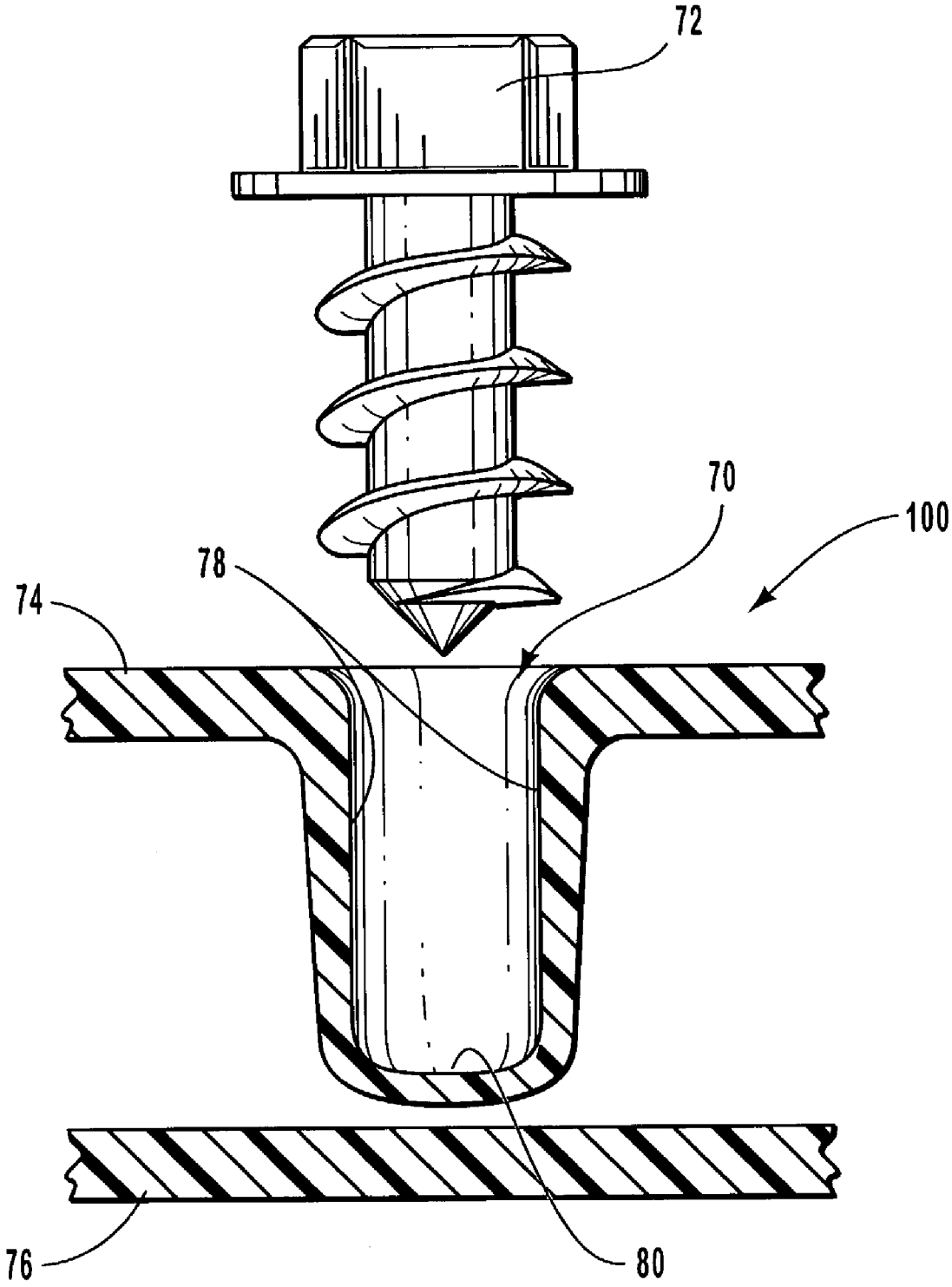
FIG. 13 is an enlarged cross-sectional side view of an exemplary portion of a basketball backboard frame, illustrating another embodiment of a screw boss and an exemplary fastener.

As shown in FIGS. 12 and 13, the support frame 14 may incorporate one or more screw bosses 70 to allow a fastener 72 to be connected to the frame. The fastener 72, for example may be used to attach the frame to a support structure. The screw boss 70 is located in one surface 74 and it extends towards a second surface 76. The screw boss 70 includes a wall 78 and a distal end 80. As shown in FIG. 12, the distal end 80 of the screw boss 70 contacts the opposing surface 76. However, as seen in FIG. 13, the distal end 80 of the screw boss 70 does not have to contact the opposing surface 76.

The screw boss 70 advantageously allows a fastener 72 to be attached to the support frame 14. It will be appreciated that the dimensions and size of the boss 70 will vary depending upon the application, the size of the fastener 72, and the dimensions of the frame 14.

Desirably, in order to provide a secure attachment for the fastener 72, a least two threads of the fastener should engage the inner surface of the wall 78 of the boss 70. The thickness of the wall 78 should be of sufficient thickness to allow engagement of the threads of the fastener 72 without the threads piercing the wall. It will be appreciated that the thickness and the depth of the screw boss 70 will be a function of the position of the boss 70 in the frame 14 as well as a function of the load applied to fastener 72.

The screw boss 70 is desirably located in a stretch region of the frame 14 which allows the screw boss to be formed without piercing the frame or creating a portion of the frame in which the plastic is too thin. Additionally, the screw boss 70 may be created with an open or closed distal end 80. These and other features of the screw boss 70 are described in detail in assignee's copending U.S. patent application Ser. No. 10/005,933, entitled Screw Bosses for Blow-Molded Structures, which was filed on Dec. 5, 2001, and is hereby incorporated by reference in its entirety.

As best seen in FIGS. 10 and 11, the backboard 12 is preferably bonded to the support frame 14 by an elastomeric adhesive 90. As discussed above, the backboard 12 desirably includes a bonding surface 36, and the support frame 14 includes a bonding surface 32. The elastomeric adhesive 90 is sandwiched between the two bonding surfaces 32 and 36 and the adhesive securely attaches the acrylic backboard 12 to the frame 14.

Applicant determined that after testing a large number of various elastomeric adhesives from different suppliers, silicone adhesive was preferred because it provides a bond of sufficient strength and flexibility, comparable to that obtained with conventional foam filled, two-sided tape. It was also preferred because of its low cost and availability. Other adhesives, such as urethane, polyurethane, hot melt adhesives, methylmethacrylate, and cyanoacrylate adhesives did not perform as well as silicone in providing the desired balance between bond strength and flexibility and/or were more expensive.

Applicant's testing indicated that silicone adhesive is preferred to attach the backboard 12 to the frame 14. A suitable type of silicone adhesive can be obtained from the General Electric Company (Part No. D1-SEA 210) or from the Dow Corning Company (Part No. Q3-6093). These commercially available silicone adhesive includes dimethylpolysiloxane as a primary ingredient, with N-propylsilicate, aminopropyltriethoxysilane, 1,3,5-tris(trimethoxysilylpropylisocyanurate) as minor ingredients. One skilled in the art will appreciate that other silicone adhesives, elastomeric adhesives, and other types of adhesives may be used to attach the backboard 12 to the support frame 14.

As shown in FIGS. 10 and 11, the silicone adhesive desirably has a bond gap "A" in the range from about 2.0 to 2.5 mm (0.08 to 0.1 inch). Significantly, if the bond gap "A" is too small, there may not be sufficient flexibility in the bond to dissipate the impact energy from the basketball striking the backboard 12. Additionally, if the bond gap "A" between the backboard and frame is too rigid, then the backboard may fracture. On the other hand, if the bond gap is too great, then the bond may not be strong enough to securely support the backboard 12.

The adhesive bond gap "A" may be formed by bond gap spacers 92 located between the frame bonding surface 32 and the backboard bonding surface 36. Suitable gap spacers 92 can be any rigid structure having the desired thickness that can maintain the desired bond gap "A" between the frame and backboard bonding surfaces 32, 36. The bond gap spacers 92 preferably have a size or diameter in the range from about 2.0 to 2.5 mm (0.08 to 0.1 inch), but the size of the bond gap spacers may depend upon the intended size of the bond gap "A". In the embodiment illustrated in FIGS. 10 and 11, the bond gap spacers 92 may be dimples or spacing structures molded into the bonding surface 32 of the support frame 14. Alternatively the bond gap spacers 92 may include separate structures suspended in the adhesive. For example, spherical beads, and more preferably glass microspheres, may be another type of bond gap spacer 92. Other bond gap spacers which have been used successfully include weed trimmer line and plastic beads. Alternatively, bond gap spacers 92 do not have to be used.

One problem with conventional single stage silicone adhesive is its long cure time, typically about 24 hours or more. If the cure time is too great, then an undue amount of manufacturing space is required to store the backboard assemblies while they cure. Applicant's testing showed that using a catalyzed silicone adhesive significantly decreased the cure time. The catalyzed silicone adhesive preferably used to attach the backboard 12 to the frame 14 contains two parts: (1) the adhesive itself and (2) a separate catalyst which is mixed with the adhesive to initiate curing. The ratio of catalyst to adhesive is preferably combined to provide a set time in the range from 5 minutes to 1 hour, and more preferably a set time in the range from about 7 to 15 minutes. The set time is the time at which the adhesive sets sufficiently to enable the backboard assembly to be moved and handled.

The bonding of the basketball backboard 12 to the support frame 14 by an adhesive can be partially or fully completed by an automated process. For example, a suitable robotic device can be used to attach the backboard 12 to the frame 14, thereby substantially reducing the assembly time and manual labor previously required to prepare backboard goal assemblies.

In greater detail, the backboard 12 is attached to the frame 14 by preparing bonding surfaces 32, 36 to receive the elastomeric adhesive 90. For the frame bonding surface 32, this may be performed by roughening the surface. For instance, the surface 32 can be roughened by rubbing a scouring pad, of the type commonly found in kitchens, over the surface. For the backboard bonding surface 36, it may be chemically treated to break the surface tension. Although the treatment will vary depending on the adhesive used, it typically will include a chemical mixture of acetone and the adhesive itself. The appropriate preparation of the backboard bonding surface 36 is usually provided by the supplier of the elastomeric adhesive 90.

It has been found that when the backboard bonding surface 36 contains a printed image, the printing itself provides an adequate surface preparation for the elastomeric adhesive 90 such that a separate backboard surface preparation step is not necessary. The backboard surface preparation step, however, may be performed if desired.

Significantly, the elastomeric adhesive 90 can be applied to either or both the backboard or frame bonding surfaces 32, 36. For example, if the adhesive 90 is applied to the bonding surface of the backboard 36, then the support frame 12 is placed against the backboard 12 such that the bonding surface of the frame 32 contacts the adhesive. Alternatively, if the adhesive 90 is applied to the bonding surface of the frame 32, then the backboard 12 is placed against the frame 14 such that the bonding surface of the backboard 36 contacts the adhesive.

In either case, a predetermined bond gap "A" is maintained between the backboard bonding surface 36 and the frame bonding surface 32. As discussed above, the bond gap "A" may be important to achieving a suitable balance between adhesion and flexibility. Additionally, as shown in FIG. 3 a bond width "B" may be used when the adhesive 90 is applied to the frame 14 or backboard 12. A desirable bond width "B" may be in the range from about 1 cm to 2 cm, but the bond widths may vary depending upon various factors such as the type of adhesive 90 or intended use of the basketball goal system 10. In some applications, for example, the bond width "B" may be equal to the width of the frame 14. Other applications may have intermittent adhesive placement, for example, with both wide and narrow distributions. Yet other embodiments may only use a thin line of adhesive at selected locations on the frame 14. The attachment of the backboard and frame is also described in detail in assignee's copending U.S. patent application Ser. No. 09/228,325, entitled System and Method for Bonding an Acrylic Surface to a Frame, which was filed on Jan. 11, 1999, and is hereby incorporated by reference in its entirety.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A basketball backboard system comprising:

a unitary, one-piece, blow-molded plastic backboard frame including a front face and a rear face that are spaced apart, a hollow interior portion disposed between the front face and the rear face, the hollow interior portion being formed during the blow-molding process, the blow-molded plastic backboard frame comprising:

an outer periphery including an inner portion and an outer portion that are separated by a distance, the outer portion forming at least a portion of an outer boundary of the frame;

a central opening disposed within the outer periphery, the central opening extending completely through the frame and being sized and configured to allow light to pass through, the inner portion of the outer periphery defining at least a portion of the central opening, the central opening including a length and a width that is substantially greater than the distance separating the inner portion and the outer portion of the outer periphery so that the central opening is substantially larger than the outer periphery; and a support portion integrally connected to and disposed within the outer periphery, the support portion including a front portion that is generally aligned with and contiguous with at least a front portion of the outer periphery, the support portion dividing the central opening into at least two openings disposed between the support portion and the outer periphery; and a first attachment area disposed on the front face of the blow-molded plastic backboard frame; and a rebound member including a second attachment area, the first attachment area and the second attachment area being sized and configured to allow the rebound member to be attached to the blow-molded plastic backboard frame and cover at least a substantial portion of the at least two openings created by the support portion.

2. The basketball backboard system of claim 1, wherein the support portion has a generally H-shaped configuration that divides the central opening into at least four openings located between the support portion and the outer periphery; and wherein the rebound member covers at least a substantial portion of the four openings.

3. The basketball backboard system of claim 2, wherein the generally H-shaped support portion includes a first generally upright member, a second generally upright member and a generally horizontal support member.

4. The basketball backboard system of claim 3, further comprising a target area disposed on the rebound member, the target area hiding at least a portion of the first upright member, the second upright member and the horizontal support member when the front face of the backboard frame is viewed.

5. The basketball backboard system of claim 1, further comprising one or more depressions formed in the backboard frame, the depressions generally extending towards an opposing surface of the backboard frame, the depressions being sized and configured to increase the strength of the backboard frame.

6. The basketball backboard system of claim 5, wherein at least one of the depressions includes a distal end that engages an opposing surface of the backboard frame.

7. The basketball backboard system of claim 5, wherein at least one of the depressions includes a distal end that is disposed proximate an opposing surface of the backboard frame.

8. The basketball backboard system of claim 5, wherein at least one of the depressions is located in the rear face of the backboard frame.

9. The basketball backboard system of claim 5, wherein at least one of the depressions is located in the front face of the backboard frame.

10. The basketball backboard system of claim 9, wherein at least a portion of the depressions located in the front face of the backboard frame are generally hidden from view by the rebound member.

11. The basketball backboard system of claim 5, wherein at least one of the depressions is located in the front face of the backboard frame and at least one of the depressions is located in the rear face of the backboard frame, at least one of the depressions in the front face engaging at least one of the depressions located in the rear face of the backboard frame.

12. The basketball backboard system of claim 5, wherein at least one of the depressions is located in the front face of the backboard frame and at least one of the depressions is located in the rear face of the backboard frame, at least one of the depressions in the front face being disposed proximate at least one of the depressions located in the rear face of the backboard frame.

13. The basketball backboard system of claim 1, further comprising a screw boss formed in the backboard frame, the screw boss including a distal end that engages an opposing surface of the frame.

14. The basketball backboard system of claim 1, further comprising a screw boss formed in the backboard frame, the screw boss including a distal end that is disposed proximate an opposing surface of the frame.

15. A basketball backboard frame that is sized and configured to support a basketball backboard above a playing surface during a game of basketball, the basketball backboard frame being constructed from blow-molded plastic, the basketball backboard frame including a front wall that is spaced apart from a rear wall and including a hollow interior portion disposed between the front wall and the rear wall, the basketball backboard frame being constructed as a unitary, one-piece structure, the basketball backboard frame comprising:

an outer periphery of the frame, the outer periphery including an inner portion and an outer portion that are separated by a distance, the outer periphery forming at least a portion of an outer boundary of the frame;

a central opening disposed within the outer periphery, the central opening extending completely through the frame and being sized and configured to allow light to pass through, the inner portion of the outer periphery defining at least a portion of the central opening, the central opening including a length and a width that is substantially greater than the distance separating the inner portion and the outer portion of the outer periphery so that the central opening is substantially larger than the outer periphery; and a support portion integrally connected to and disposed within the outer periphery, the support portion including a front portion that is generally aligned with and contiguous with at least a front portion of the outer periphery, the support portion dividing the central opening into at least two openings disposed between the support portion and the outer periphery.

16. The basketball backboard frame of claim 15, wherein the support portion has a generally H-shaped configuration that divides the central opening into at least four openings located between the support portion and the outer periphery.

17. The basketball backboard frame of claim 16, wherein the generally H-shaped support portion includes a first generally upright member, a second generally upright member and a generally horizontal support member.

18. The basketball backboard frame of claim 15, further comprising a basketball backboard attached to the frame.

19. The basketball backboard frame of claim 18, further comprising a generally rectangular target area disposed on the basketball backboard, the target area covering at least a portion of the first generally upright member, the second generally upright member and the generally horizontal member of the generally H-shaped support structure.

20. The basketball backboard frame of claim 15, further comprising one or more depressions formed in the frame, the depressions generally extending towards an opposing surface of the frame and being sized and configured to increase the strength of the frame.

21. The basketball backboard frame of claim 20, wherein each of the one or more depressions includes a distal end that engages a portion of an opposing surface of the frame.

22. The basketball backboard frame of claim 20, wherein each of the one or more depressions includes a distal end that is disposed proximate an opposing surface of the frame.

23. The basketball backboard frame of claim 20, wherein at least some of the one or more depressions are located in the rear wall of the basketball frame.

24. The basketball backboard frame of claim 20, wherein at least some of the one or more depressions are located in the front wall of the basketball frame.

25. The basketball backboard frame of claim 24, further including a basketball backboard attached to the frame and wherein at least a portion of the one or more depressions located in the front wall of the basketball frame are capable of being at least generally hidden from view by the basketball backboard.

26. The basketball backboard frame of claim 20, wherein one or more depressions are located in the front wall of the basketball frame and one or more depressions are located in the rear wall of the basketball frame.

27. The basketball backboard frame of claim 26, wherein a portion of the one or more depressions located in the front wall of the basketball frame contact a portion of the one or more depressions located in the rear wall on the rear surface of the basketball frame.

28. The basketball backboard frame of claim 15, further comprising a screw boss located in the basketball frame.

29. The basketball backboard frame of claim 28, wherein the screw boss includes a distal end that engages an opposing surface of the frame.

30. The basketball backboard frame of claim 28, wherein the screw boss includes a distal end that is disposed proximate an opposing surface of the frame.

31. A basketball backboard comprising:

a unitary, one-piece backboard frame constructed from blow-molded plastic, the backboard frame including a front face, a rear face and a hollow interior portion that is disposed between the front face and rear face and formed during the blow-molding process, the backboard frame including an attachment portion, the backboard frame comprising:

an outer periphery including an inner portion and an outer portion that are separated by a distance, the outer portion forming at least a portion of an outer boundary of the frame;

a central opening disposed within the outer periphery, the central opening extending completely through the frame and being sized and configured to allow light to pass through, the central opening including a length and a width that are substantially greater than the distance separating the inner portion and the outer portion of the outer periphery so that the central opening is substantially larger than the outer periphery; and a support portion integrally connected to and disposed within the outer periphery, the support portion including a front portion that is generally aligned with and contiguous with at least a front portion of the outer periphery, the support portion dividing the central opening into at least two openings disposed between the support portion and the outer periphery; and a rebound member including a generally planar front face and an attachment portion, the attachment portion of the rebound member being at least partially attached to the attachment portion of the backboard frame, the rebound member covering at least a portion of the openings disposed between the support portion and the inner portion of the outer periphery.

32. The basketball backboard of claim 31, further comprising a generally rectangular target area disposed on the rebound member, the target area hiding at least a portion of the support portion when the front face of the backboard frame is viewed.

33. The basketball backboard of claim 31, further comprising an outer periphery of the backboard frame that is generally aligned with an outer edge of the rebound member.

34. The basketball backboard of claim 31, wherein the attachment portion of the backboard frame includes a recess formed in the front face of the backboard frame, the recess being formed as an integral part of the unitary, one-piece backboard frame, the rebound member being sized and configured to be disposed at least partially within the recess.

35. The basketball backboard of claim 31, wherein the support portion has a generally H-shaped configuration including a first generally upright member, a second generally upright member and a generally horizontal support connecting the first generally upright member and the second generally upright member.

36. The basketball backboard of claim 31, further comprising one or more depressions formed in the backboard frame, the depressions generally extending towards an opposing surface of the backboard frame, the depressions being sized and configured to increase the strength of the backboard frame.

37. The basketball backboard of claim 36, wherein at least one of the depressions includes a distal end that engages an opposing surface of the backboard frame.

38. The basketball backboard of claim 36, wherein at least one of the depressions includes a distal end that is disposed proximate an opposing surface of the backboard frame.

39. The basketball backboard of claim 36, wherein at least one of the depressions is located in the rear face of the backboard frame.

40. The basketball backboard of claim 36, wherein at least one of the depressions is located in the front face of the backboard frame.

41. The basketball backboard of claim 40, wherein at least a portion of the depressions located in the front face of the backboard frame are generally hidden from view by the rebound member.

42. The basketball backboard of claim 36, wherein at least one of the depressions is located in the front face of the backboard frame and at least one of the depressions is located in the rear face of the backboard frame, at least one of the depressions in the front face engaging at least one of the depressions in the rear face of the backboard frame.

43. The basketball backboard of claim 36, wherein at least one of the depressions is located in the front face of the backboard frame and at least one of the depressions is located in the rear face of the backboard frame, at least one of the depressions in the front face being disposed proximate to at least one of the depressions in the rear face of the backboard frame.

44. The basketball backboard of claim 31, further comprising a screw boss formed in the backboard frame, the screw boss including a distal end that engages an opposing surface of the frame.

45. The basketball backboard of claim 31, further comprising a screw boss formed in the backboard frame, the screw boss including a distal end that is disposed proximate an opposing surface of the frame.

46. A basketball backboard frame that is sized and configured to support a basketball backboard above a playing surface during a game of basketball, the backboard frame being constructed from blow-molded plastic, the backboard frame including a front wall that is spaced apart from a rear wall and including a hollow interior portion disposed between the front wall and the rear wall, the backboard frame being constructed as a unitary, one-piece structure, the backboard frame comprising:

an outer periphery of the frame, the outer periphery including an inner portion and an outer portion that are separated by a distance, the outer periphery forming at least a portion of an outer boundary of the frame;

a central opening disposed within the outer periphery, the central opening extending completely through the frame and being sized and configured to allow light to pass through, the inner portion of the outer periphery defining at least a portion of the central opening, the central opening including a length and a width that is substantially greater than the distance separating the inner portion and the outer portion of the outer periphery so that the central opening is substantially larger than the outer periphery;

a support portion disposed within the outer periphery of the frame and dividing the frame into at least two openings located between the support portion and the outer periphery; and one or more depressions formed in the frame, the depressions generally extending towards an opposing surface of the frame and being sized and configured to increase the strength of the frame;

wherein each of the one or more depressions includes a distal end that engages a portion of an opposing surface of the frame.

47. A basketball backboard frame that is sized and configured to support a basketball backboard above a playing surface during a game of basketball, the backboard frame being constructed from blow-molded plastic, the backboard frame including a front wall that is spaced apart from a rear wall and including a hollow interior portion disposed between the front wall and the rear wall, the backboard frame being constructed as a unitary, one-piece structure, the backboard frame comprising:

an outer periphery of the frame, the outer periphery including an inner portion and an outer portion that are separated by a distance, the outer periphery forming at least a portion of an outer boundary of the frame;

a central opening disposed within the outer periphery, the central opening extending completely through the frame and being sized and configured to allow light to pass through, the inner portion of the outer periphery defining at least a portion of the central opening, the central opening including a length and a width that is substantially greater than the distance separating the inner portion and the outer portion of the outer periphery so that the central opening is substantially larger than the outer periphery;

a support portion disposed within the outer periphery of the frame and dividing the frame into at least two openings located between the support portion and the outer periphery; and one or more depressions formed in the frame, the depressions generally extending towards an opposing surface of the frame and being sized and configured to increase the strength of the frame;

wherein one or more depressions are located in the front wall of the basketball frame and one or more depressions are located in the rear wall of the basketball frame; and wherein a portion of the one or more depressions located in the front wall of the basketball frame contact a portion of the one or more depressions located in the rear wall on the rear surface of the basketball frame.

48. A basketball backboard comprising:

a unitary, one-piece backboard frame constructed from blow-molded plastic, the backboard frame including a front face, a rear face and a hollow interior portion that is disposed between the front face and rear face and formed during the blow-molding process, the backboard frame including an attachment portion, the backboard frame comprising:

an outer periphery including an inner portion and an outer portion that are separated by a distance, the outer portion forming at least a portion of an outer boundary of the frame;

a central opening disposed within the outer periphery, the central opening extending completely through the frame and being sized and configured to allow light to pass through, the central opening including a length and a width that are substantially greater than the distance separating the inner portion and the outer portion of the outer periphery so that the central opening is substantially larger than the outer periphery; and a support portion connected to the inner portion of the outer periphery and forming at least two openings disposed between the support portion and the inner portion of the outer periphery;

a rebound member including a generally planar front face and an attachment portion, the attachment portion of the rebound member being at least partially attached to the attachment portion of the backboard frame, the rebound member covering at least a portion of the openings disposed between the support portion and the inner portion of the outer periphery; and one or more depressions formed in the backboard frame, the depressions generally extending towards an opposing surface of the backboard frame, the depressions being sized and configured to increase the strength of the backboard frame;

wherein at least one of the depressions includes a distal end that engages an opposing surface of the backboard frame.

49. A basketball backboard comprising:

a unitary, one-piece backboard frame constructed from blow-molded plastic, the backboard frame including a front face, a rear face and a hollow interior portion that is disposed between the front face and rear face and formed during the blow-molding process, the backboard frame including an attachment portion, the backboard frame comprising:

an outer periphery including an inner portion and an outer portion that are separated by a distance, the outer portion forming at least a portion of an outer boundary of the frame;

a central opening disposed within the outer periphery, the central opening extending completely through the frame and being sized and configured to allow light to pass through, the central opening including a length and a width that are substantially greater than the distance separating the inner portion and the outer portion of the outer periphery so that the central opening is substantially larger than the outer periphery; and a support portion connected to the inner portion of the outer periphery and forming at least two openings disposed between the support portion and the inner portion of the outer periphery;

a rebound member including a generally planar front face and an attachment portion, the attachment portion of the rebound member being at least partially attached to the attachment portion of the backboard frame, the rebound member covering at least a portion of the openings disposed between the support portion and the inner portion of the outer periphery; and one or more depressions formed in the backboard frame, the depressions generally extending towards an opposing surface of the backboard frame, the depressions being sized and configured to increase the strength of the backboard frame;

wherein at least one of the depressions is located in the front face of the backboard frame and at least one of the depressions is located in the rear face of the backboard frame, at least one of the depressions in the front face engaging at least one of the depressions in the rear face of the backboard frame.

* * * * *

UNITED STATES PATENT AND TRADEMARK OFFICE

CERTIFICATE OF CORRECTION

PATENT NO. : 7,001,290 B2
APPLICATION NO. : 10/352940
DATED : February 21, 2006
INVENTOR(S) : Mower et al.

It is certified that error appears in the above-identified patent and that said Letters Patent is hereby corrected as shown below:

Column 2
Line 53, change "attached" to --attaching--
Line 66, after "opening", change "Is" to --is--

Column 5
Line 44, change "limits" to --limit--

Column 9
Line 12, remove [34]
Line 13, remove [34]

Column 13
Line 18, change "includes" to --include--

Signed and Sealed this

Fifth Day of September, 2006

JON W. DUDAS
*Director of the United States Patent and Trademark Office*